United States Patent [19]

McMullan et al.

[11] 4,220,848

[45] Sep. 2, 1980

[54] WATER BED HEATER

[76] Inventors: James P. McMullan; Albert Stevens, both of 2630 Seaman Ave., El Monte, Calif. 91753

[21] Appl. No.: 954,406

[22] Filed: Oct. 25, 1978

[51] Int. Cl.[2] ..... H05B 3/34

[52] U.S. Cl. ..... 219/528; 219/217; 219/345; 219/527; 219/549

[58] Field of Search ..... 219/211, 212, 217, 345, 219/430, 527, 528, 529, 530, 540, 544, 548, 549; 338/210, 212, 214

[56] References Cited

U.S. PATENT DOCUMENTS

| | | | |
|---|---|---|---|
| 1,455,909 | 5/1923 | Ditton | 219/430 |
| 2,783,358 | 2/1957 | Wolf | 219/345 X |
| 2,889,445 | 6/1959 | Wolf | 219/345 |
| 3,028,477 | 4/1962 | Russell, Jr. | 219/528 |
| 3,084,241 | 4/1963 | Carrona | 219/211 |
| 3,119,918 | 1/1964 | Simon | 219/345 |
| 3,153,140 | 10/1964 | Theodore et al. | 219/549 |
| 3,191,005 | 6/1965 | Cox | 219/528 |
| 3,790,753 | 2/1974 | Miller | 219/528 |
| 3,812,320 | 5/1974 | Borgren | 219/213 |
| 3,842,241 | 10/1974 | Issacson | 219/345 X |

*Primary Examiner*—Volodymyr Y. Mayewsky

*Attorney, Agent, or Firm*—Georges A. Maxwell

[57] ABSTRACT

A soft, resilient and flexible blanket type electric resistance heater comprising a sheath including top and bottom panels of thin, supple, flexible and elastic sheet material and substantially similar in plan configuration; an elongate, flexible electric resistance element having greater tensile strength than the sheath is loosely arranged in a slack serpentine pattern between and throughout the plane of the panels with adjacent portions in variable spaced relationship from each other; the edge portions of the panels are fixed together about their perimeters; the panels are fixed together at locations between and spaced from adjacent related portions of the element to maintain adjacent portions of the element in spaced relationship from each other; the air in the space between the panels is exhausted therefrom to reduce the presence of heat insulating dead air spaces between the panels and to permit the panels to establish substantially uniform heat conducting contact with the element; a power supply cord has one end portion entering the space between the panels and has conductors connected with related ends of the heating element and has another end portion extending from the heater to connect with a power supply.

6 Claims, 9 Drawing Figures

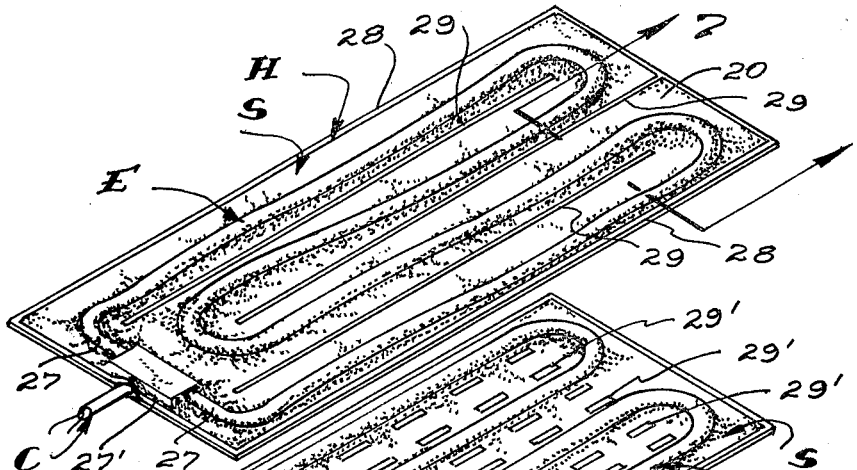
Fig. 4.
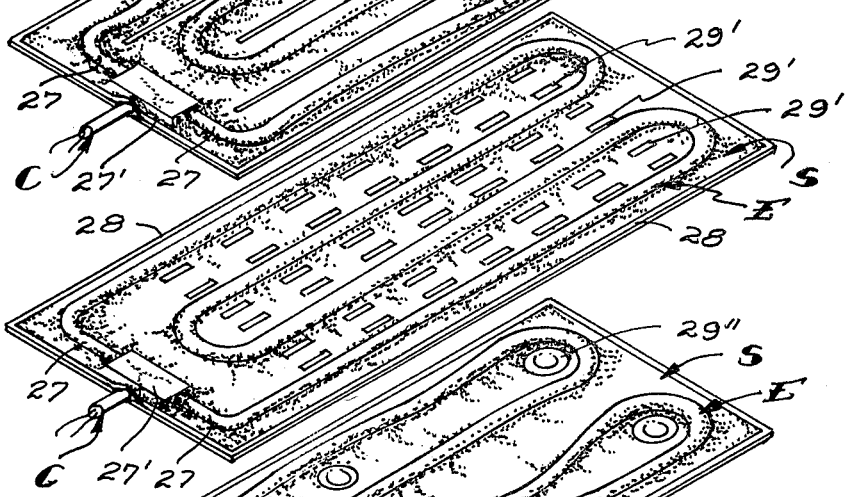
Fig. 5.
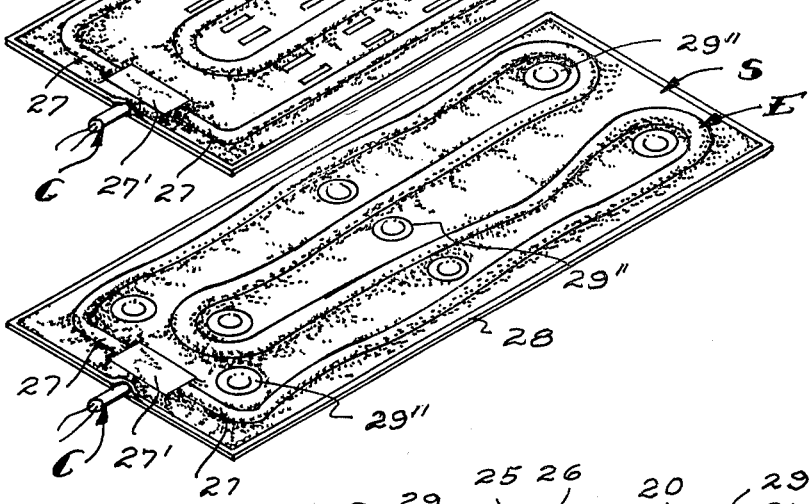
Fig. 6.
Fig. 7.
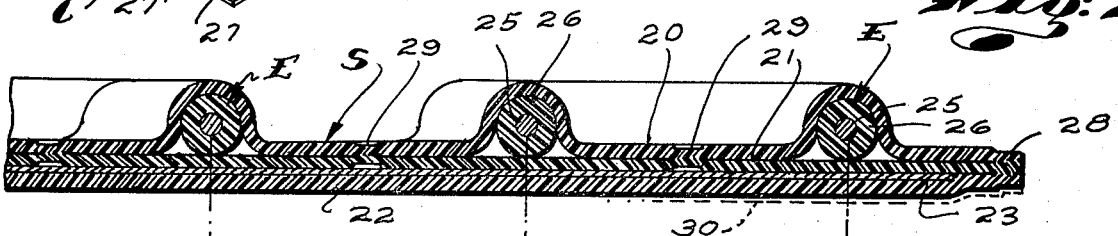
Fig. 8.
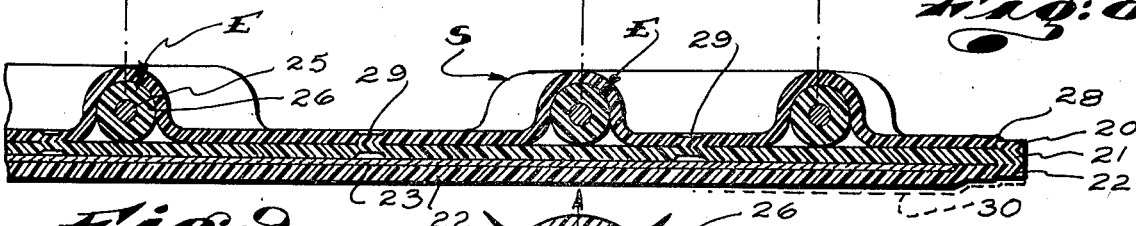
Fig. 9.
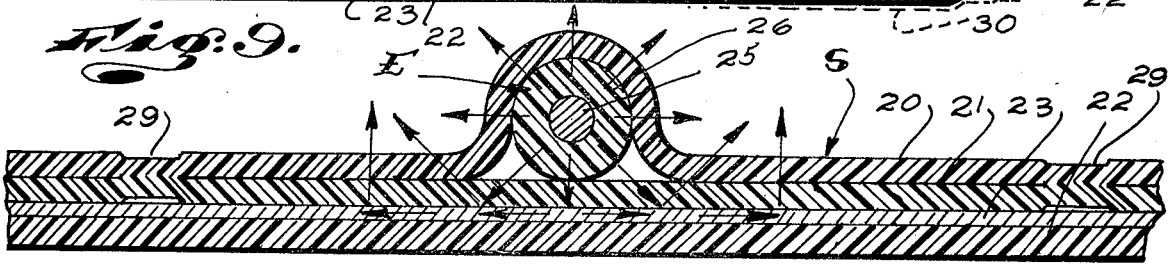

WATER BED HEATER

This invention has to do with a flexible, blanket-type electric resistance heater and is particularly concerned with a heater for engagement with and between opposing surfaces of two adjacent flexible and displaceable structures.

The present invention relates to the art of water beds and specifically to an improved heater for engagement with and between a rigidly supported resilient foam pad and a water mattress overlying and supported by the pad.

Ordinary or conventional water bed mattresses are simple water-filled bladders of soft, supple and elastic plasticized monomeric vinyl plastic. In the past, and to this date, most water beds comprise a mattress such as referred to above engaged on a flat horizontal platform and within a frame having vertical side walls. The ordinary or conventional water bed further includes a liner of similar vinyl plastic arranged between the mattress, platform and frame to protect the mattress from irregularities that might occur in the platform and frame and which serves to catch and retain water, should the mattress rupture or leak.

The mattresses of conventional water beds such as referred to above are made amply thick or deep so that in normal use, when the weight of persons atop the beds is concentrated in small areas, the likelihood that the bodies of such persons will so displace the water in the mattresses that they strike or stretch the bladders and stop against the platform, or "bottom out", is not likely to occur. To this end, water bed mattresses are normally from 8" to 10" deep. The large volumes and masses of water in such beds require a great deal of energy to heat. Finally, the great depth and large volumes of water in such beds establish or create structures which are excessively fluid and such that undesirably large wave action and surges are generated in response to normal or minimal body motion of persons on the beds.

In the recent past, in order to reduce the mass, reduce the volume of water required and to reduce the wave action or surging in water beds, the art has developed foam water beds, which beds differ from conventional water beds in that the mattresses are about one-half as deep as conventional water bed mattresses; that is, about 4" or 5" deep and a lightweight, soft and resilient pad of foam plastic, about 2" thick is interposed between the mattresses and their supporting platforms. In the case of foam water beds, persons lying on the beds are wholly fuidly supported by the mattresses when they lie quietly thereon or engage in mild non-forceful physical activities; and, readily "bottom out" through the mattresses and yieldingly compress or deform the more resistive resilient pads beneath the mattresses when their physical activities become forceful and such that concentrated forces of moderate to high magnitudes are imposed through the mattresses and into the pads. Such "bottoming out" of the mattresses and compressive deforming of the pads is a desirable end, sought to be attained under the noted special circumstances.

For effective and comfortable use of water beds, heating means are required and are employed to raise and maintain the temperature of the water mattresses at a temperature which is comfortable and safe for the uses of the beds.

Water bed heater means commonly consist of flat blanket type electric resistance heaters arranged beneath the mattresses to occur between the mattresses and their underlying supportive structure. In the case of conventional water beds, the heaters occur between the mattresses and the flat rigid platforms of the beds on which the mattresses are supported. In foam water bed structures the heaters must be arranged between the mattresses and the soft resilient pads, which pads are supported on the platforms.

In the case of conventional water beds, where the heaters are supported and maintained flat and in stationary position on top of the platforms, and the bottom portions of the mattresses which engage and overlie the heaters, remain flat and stationary, the heaters and their related portions of the mattresses are static and not subject to any adverse effects which might occur or develop should their condition be other than static. In the case of foam-water beds, where the heaters occur between the mattresses and the resilient supportive pads therefore and where bottoming out of the mattresses and depressive deformation of the heaters and the pads is to be encountered, the heaters are in a non-static environment, are subject to being deformed by dynamic forces directed therethrough and are subject to a multitude of adverse effects that such deformation and dynamic forces are likely to cause.

To the best of our knowledge and belief, all commercially available blanket type heaters for use in connection with water beds were originally designed and intended for use in the above noted static conditions found in conventional water beds and cannot be effectively and safely used in those non-static conditions which are to be found in foam water beds.

A principal factor which renders most ordinary commercially available water bed heaters unsuitable for use in foam water beds is embrittlement of the plasticized vinyl mattresses, adjacent the heaters, which embrittlement results in cracking or breaking and separation of the walls of the mattresses upon flexure thereof and leaking of water from the mattresses. Embrittlement of the plastic in such mattresses is brought about by excessive heat which drives the plasticizers out of the vinyl and/or by establishing the heaters of materials which are non-compatible with the vinyl and which attract and absorb the plasticizers from the vinyl of the mattresses.

It has been determined that the vinyl commonly used in establishing water bed mattresses is such that the plasticizer therein is driven therefrom at an accelerated rate at temperatures in excess of about 115° F. Accordingly, to avoid embrittlement of the mattresses of foam water beds, heaters related thereto should not operate to raise the temperature of the plastic adjacent thereto, above 115° F.

It has been determined that to prevent embrittlement of the mattresses of foam water beds, adjacent the heaters related thereto, the heaters should be made of a compatible material which will not draw and absorb the plasticizer from the vinyl of the mattresses.

To this end, it is desirable that the envelopes or sheaths of the heaters be established of the same material as the mattresses or that the heaters be provided with barriers of material, such as thermo-set plastic film, through which plastizers cannot travel or move.

In the prior art, little or no attention has been given to the problem of embrittlement of the plastic of water bed mattresses, adjacent the heaters provided therefore since the heaters have been designed and intended for use in combination with conventional water beds where the heaters and the portions of the mattresses adjacent thereto are static and such that embrittlement of the mattresses will normally have no adverse effects. The sheaths or envelopes of some commercially available water bed mattress heaters are established of synthetic rubber compounds which may be totally incompatible with, have a high affinity to, and readily absorb the plasticizers used in vinyl.

Another factor which renders most ordinary commercially available water bed heater structures unsuitable for use in foam water beds resides in the fact that they are designed and intended for use in static conditions and cannot withstand repeated flexing or the imposition of dynamic forces therethrough without work hardening, stretching or separating the heating elements thereof, with resulting adverse alteration of the resistive characteristics and/or destruction of the heating elements.

In most heaters for water beds, the heating elements are elongate wires or foil ribbons of resistive metal arranged and securely held in substantial serpentine or zig-zag manner within the flexible sheaths or envelopes of the heaters. Due to the weight and configuration of the heating elements and/or due to the manner in which they are arranged and held within their related sheaths when the sheaths are flexed, deformed and/or stretched, as heater related to foam water bed structures are flexed, deformed and/or stretched in normal use of such bed structures, the elements in the heaters are flexed, deformed and/or stretched therewith. As a result of such deforming and stretching of the heater elements, adverse alteration of the resistive characteristics or breaking and parting of the elements results in malfunctioning of or renders the heaters inoperative.

Work hardening or stretching and necking down of the heater elements in such heaters results in changing the local resistive characteristics of the elements and the establishment of hot spots in the heaters where excessively high and oftentimes destructive temperatures are generated.

In foam water bed structures, where heaters are arranged between the liners below the mattresses and the resilient foam pads, the pads absorb the heat generated by the heaters and can increase in temperature to that point where degradation of the foam of which the pads are made can occur. Such degradation of the foam material and ultimate destruction of the pads can take place at a rapid rate.

An object of the invention is to provide a novel blanket heater structure which is particularly suited for use in foam water beds and which overcomes each of the above noted shortcomings found in conventional water bed heaters provided by the prior art when used with such beds.

It is an object and feature of our invention to provide a heater structure of the general character referred to above which includes a flat envelope like sheath which is established or polymerized vinyl or plastic similar to the vinyl or plastic of which the related foam water bed mattress, liner and pad are established whereby virtually no transfer or migration of plasticizer takes place between the parts of the assembly to cause embrittlement thereof.

Another object and feature of our invention is to provide a heater structure of the general character referred to above which includes an elongate, flexible, electric resistance heating element including a central resistance wire and a plasticized vinyl jacket, arranged in a zig-zag or serpentine pattern between substantially flat adjacent plastic laminates or panels of the heater sheath, with all portions of the element in suitable spaced relationship from each other.

Yet another object and feature of our invention is to provide a heater structure of the character referred to above wherein the heating element is movably or shiftably engaged between its related panels of the sheath whereby the sheath can move relative to the element when the sheath is flexed, deformed and/or stretched to conform with deformation of the parts of the bed structure with which the heater is related.

Still another object and feature of our invention is to provide a heater structure of the general character referred to in the foregoing wherein the plastic panels related to and between which the heating element is arranged are welded together at locations spaced from and between adjacent or related portions of the heating element, whereby displacement or movement of the heating element between the panels is restricted or limited to an extent that the heating element is maintained in substantial balanced relationship throughout the plane of the heater structure and so that adjacent portions of the element are maintained in sufficient spaced relationship from each other to prevent the watt density of the heater structure from increasing undesirably in localized areas or zones of the heater structure.

It is yet another object and feature of our invention to provide a heater of the general character referred to above wherein the sheath can be hermetically sealed and sufficient air is exhausted from its interior whereby atmospheric pressure urges portions of the panels adjacent the heating elements into intimate heat conducting contact about the major surface areas of the elements and so that the portions of the panels between adjacent or related portions of the element are urged and remain in substantial uniform heat conducting contact with each other at all times, whereby the heat conducting characteristics and distributing characteristics of the heater structure are not interfered with or adversely affected by the existence or presence of dead air spaces of random size and shape between and throughout the panels enveloping the heater element.

It is an object and feature of our invention to provide a heater structure of the general character referred to above wherein the sheath has soft, flexible upper and lower plastic panels between which the heating element is arranged, a base laminate of similar plastic below the lower panel and a thin, flexible heat reflecting stratum between the lower panel and the base laminate, whereby heat generated by the heating element and directed downwardly and heat conducted downwardly through the sheath, above the base laminate, and impinging upon the stratum, is conducted horizontally and is reflected upwardly through and out of the heater structure and into the water mattress.

The foregoing and other objects and features of our invention will become apparent and will be fully understood from the following detailed description of typical preferred forms and embodiments of our invention, throughout which description reference is made to the accompanying drawings.

DESCRIPTION OF THE DRAWINGS

FIG. 4 is an isometric view of our heater;

FIGS. 5 and 6 are views similar to FIG. 4 showing other embodiments of our invention;

FIG. 7 is an enlarged detailed sectional view taken substantially as indicated by line 7—7 on FIG. 4;

FIG. 8 is a view similar to FIG. 7 showing parts in another position; and

FIG. 9 is an enlarged detailed sectional view of a portion of the structure shown in FIGS. 7 and 8 of the drawings.

DETAILED DESCRIPTION OF THE INVENTION

Figure 1:
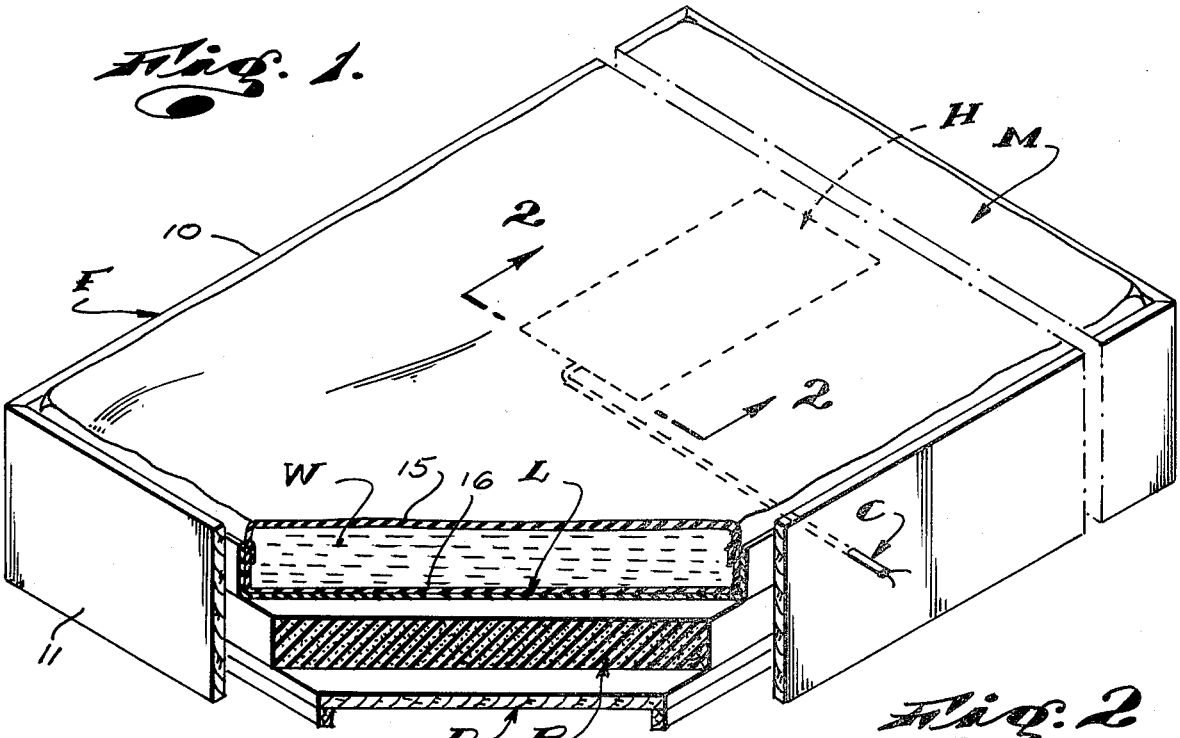
FIG. 1 is an isometric view of a foam water bed structure with our new heater related to it.
Figure 2:
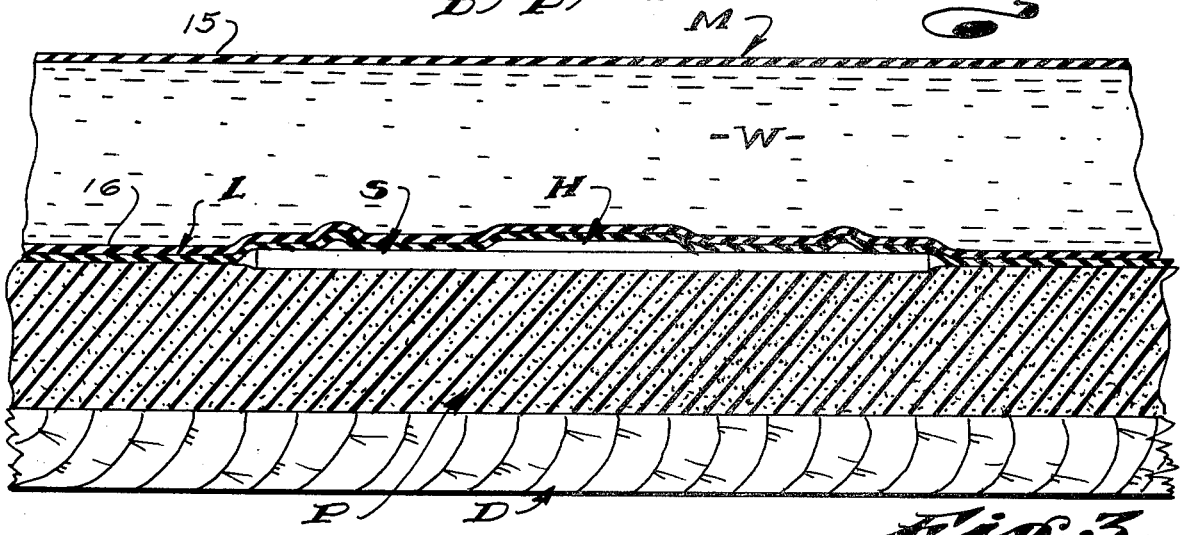
FIG. 2 is an enlarged detailed sectional view taken substantially as indicated by line 2—2 on FIG. 1.
Figure 3:
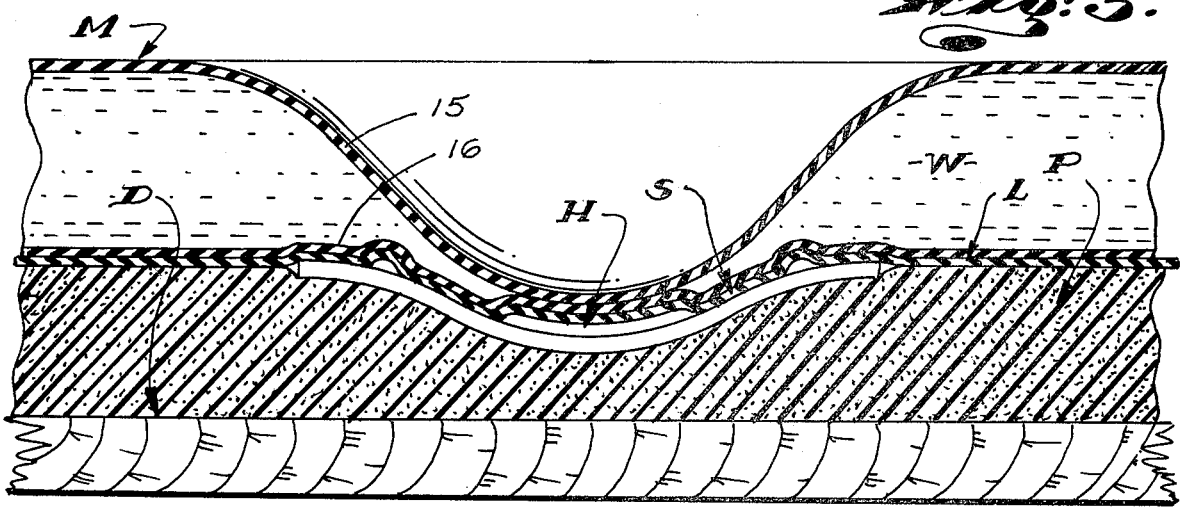
FIG. 3 is a view similar to FIG. 2 showing parts in another position.

Refering to FIGS. 1 through 3 of the drawings, we show our new heater H related to or in combination with a foam water bed structure B;

The bed structure B includes a rectangular frame F with vertical side and end walls 10 and 11 and a flat horizontal deck or platform D within and spaced below the top or rim 12 of the frame F. Within the frame F and supported on top of the platform D is a flat, horizontal, soft resilient pad P of foam plastic resin. The pad is preferably 1" to 2" thick and is established of polyurethane or like foam plastic.

The bed B next includes a liner L established of a thin flexible sheet of plasticized vinyl. The liner L has a horizontal central portion overlying the platform D and vertical side portions which extend upwardly adjacent the inside surfaces of the side and end walls 10 and 11 of the frame F.

The bed B finally includes a water mattress M engaged within the frame F and atop the pad P, with the liner L arranged therebetween. The mattress M includes an outer water bladder established of upper and lower panels 15 and 16 of thin, supple and flexible sheets of plasticized vinyl plastic resin. The panels 15 and 16 have vertical sides and end portions, the edge portions of which are suitably welded together. The bladder is filled with water in sufficient volume to support the central portion of the top panel 15 on a horizontal plane substantially coplanar with or slightly above the top or rim 12 of the frame F.

The bladder or water filled mattress M is preferably 4" to 5" deep or thick. (The mattress may be covered with polyurethane foam mattress pad—not shown).

In use, the mattress M is such that a person lying atop the mattress depresses the top panel 15 and displaced sufficient water so that his body is wholly buoyantly supported thereby, with the top panel 15 in vertical spaced relationship from the bottom panel 16.

If and when the person on the bed moves forcefully on the bed and/or concentrates a great part of his body weight in a small area or areas of the mattress, the top panel 15 is or might be depressed to such an extent that it engages or bottoms out on and depresses the bottom panel 16. When the mattress bottoms out in the manner set forth above and as clearly shown in FIG. 3 of the drawings, the lower panel 16 and the pad P on which the lower panel 16 is engaged, yield and depress downwardly under the forces applied thereto. The pad, upon yielding under the load or loads applied thereto buffets, cushions and disperses the forces in such a manner that bottoming out of the pad P, on the platform, is not likely to occur and the person on the bed is guarded from any discomforting impact forces and the like.

The bed structure B set forth above is illustrative of the general or basic form of foam water bed provided by the prior art.

The structure and relationship of parts to be found in or presented by the bed structure B which go to effect the novelty of the present invention is the supple, flexible bottom panel 16 of the mattress M, the soft resilient pad P, the rigid platform D and the relationship of the panel, pad and platform with each other. The function of the mattress panel 16 and pad P to yield and deform downwardly under applied loads is of primary significance.

All other structure and details of the bed B, such as the provision of the liner L between the mattress and the pad, the construction of the frame F and/or the mattress M are subject to wide variations without in any way affecting the novelty of our invention.

In furtherance of our invention and in accordance with common practice, a blanket type electric resistance heater H is used in combination with the bed structure B described above. The heater H that we provide is particularly suited for use in combination with the foam water bed and is adapted to be arranged in flat engagement between the bottom panel 16 of the mattress M and the top of the pad P, with the liner L disposed between the heater and the mattress, when such a liner is provided.

For the purposes of this disclosure and for the purposes of claiming our heater in combination with the bed structure B, we will consider the bottom panel 16 of the mattress and the liner L as a single unit or one and will refer to them, generally, as the mattress M, where such generalization is appropriate and most expedient.

The heater H, as clearly shown in FIGS. 1, 2 and 3 of the drawings is arranged substantially centrally of the mattress M and the pad P with its top and bottom surfaces in flat bearing and supported engagement with and between the adjacent, opposing, top and bottom surfaces of the pad and mattress.

The basic parts of the heater H comprise a flat, envelope like sheath S, an elongate electric resistance element E arranged in a zig-zag or serpertine manner within and throughout the plane of the sheath and an elongate power service cord C connected with the element E and extending from the heater and from the bed structure B to a suitable power source (not shown).

In practice, the heater H can include temperature responsive control means responsive to the temperature of the mattress M and/or to the temperature of the sheath S and operable to control the power supplied to the element E. The purpose or function of such a control means is to effectively establish and maintain the mattress M at a desired temperature. Such control means can include a temperature responsive on and off type switching device within the sheath S (in suitable spaced relationship from the element E) and connected in and with a conductor line of the cord C, or can include a suitable temperature sensing device, such as a bulb or capillary type of temperature sensing device within the sheath S (in spaced relationship from the element E) and operatively connected with an on and off switch in a conductor line of the cord C.

The provision of control means of the general character referred to above, in blanket type heater structures is common practice and does not go to or affect the broader aspects and spirit of our present invention. While the possibility or likelihood that our heater H will include such a control means should be recognized and mentioned, illustration and detailed description of such a means will only serve to unduly burden this disclosure and might cloud the invention. Accordingly, we have elected not to illustrate and describe such control means and note that the inclusion of such a means can be adopted by the exercise of ordinary skill.

The envelope like sheath S that we provide is a flat horizontal laminate structure of suitable and desired plan configuration. In the case illustrated the sheath is rectangular in plan configuration, having a major longitudinal axis and a minor laberal axis. The sheath S includes a top laminate or panel 20, a bottom laminate or panel 21, a base laminate 22 and a heat reflecting stratum R between the bottom panel 21 and base laminate 22. The several laminates 20, 21 and 22 are flat, supple and flexible sheets of a plastic material which is compatible with the plastic material establishing the pad P and mattress M.

In practice, in the art of water beds, plasticized vinyl has been adapted and has become the standard plastic material used in the establishment of water bed mattresses, liners and pads. Accordingly, it is preferred that the laminates 20, 21 and 22 be established of plasticized vinyl or thermoset plastics.

The term "compatible", as here used, refers to a plastic resin or material which is such that it does not have an affinity to and will not draw and absorb plasticizer from the plastic of which the mattress M and pad P are established, to cause embrittlement of the mattress and/or pad.

The heat reflecting stratum R of the heater H can be a thin aluminum foil stratum in flat, contained, heat conducting contact with and between the panel 21 and laminate 22 or can be a surface deposit of aluminum, applied to the bottom surface of the panel 21 or top surface of the laminate 22 as by vapor deposition or lamination.

The element E includes an elongate flexible metal resistance wire 25 and a flexible plastic jacket 26 about the wire. The jacket 26 is established of a compatible plastic, such as plasticized vinyl. The element E is shown as being cylindrical in cross-section and the jacket 26 is of substantial and sufficiently large diametric extent to impart into the element E, sufficiently great tensile strength to resist stretching of the element with resulting stretching and alteration of the resistance characteristics of the wire when the element is subjected to high tensile forces. The jacket also establishes a uniform heat conducting and storing mass about the wire 25 and presents a large or estensive exterior surface for the establishment of heat conducting engagement with adjacent portions of the top panel 20, as will be described in the following:

The element E is arranged in a zig-zag or serpentine manner between the panels 20 and 21 in a substantial uniform pattern throughout the plane of the panels and with its adjacent portions in spaced relationship from each other so as to prevent adjacent portions of the element from establishing such a close relationship with each other as might noticeably increase the watt density of the heater, in any one or more areas, throughout the plane thereof.

The element E has end portions 27 which extend between the panels 20 and 21 to join with each other at a junction 27' where they connect with the cord C, which cord extends outwardly from between the panels 20 and 21 and away from the heater, as clearly illustrated in the drawings.

The top and bottom panels 20 and 21 are suitably bonded or welded together as at 28, about the perimeter of the sheath and with and about the portion of the cord C extending through the edge portion of the sheath.

In practice, the weld 28 can be such that it hermetically seals the space between those panels.

The panels 20 and 21 are further bonded or welded together at points and/or along lines between and in spaced relationship from adjacent related portions of the element E.

In one form of the invention, shown in FIG. 4 of the drawings, the panels 20 and 21 are welded together along single lines 29. The weld lines 29 occur in spaced relationship between adjacent portions of the element E.

In the form of the invention shown in FIG. 5 of the drawings, the panels 20 and 21 are spot-welded together, as at 29', along spaced parallel lines spaced between adjacent portions of the element E.

In the form of the invention shown in FIG. 6 of the drawings, the panels 20 and 21 are welded together at spots 29" occurring at spaced locations throughout the plane of the sheath to occur between and in spaced relationship from related portions of the element E whereby the element E is normally maintained in desired position within the sheath.

In practice, and in each form of the invention noted above, the top panel 20 is sufficiently larger in surface area than the panel 21 so that the panel 21 remains substantially flat and the panel 20 can be urged down into substantially conforming heat conducting contact about the upper half of the jacket 26 of the element E and so that the portions of the panel 20 between and occurring laterally of or at opposite sides of the element E can and are urged into substantially flat, uniform heat conducting contact with the top surface of the bottom panel 21, as clearly shown in FIGS. 7 and 8 of the drawings.

The top panel 20 is urged into uniform heat conducting contact with and about the upper half of the element E and urges the lower portion of the element E into uniform lineal contact with the top of the panel 21 and the panel 20 is urged into direct and substantially uniform heat conducting contact with the panel 21, laterally of the element E, by the overburden or weight of the mattress M, beneath which the heater is arranged, when in use.

In those cases where the weld 28 hermetically seals the space between the space between the panels 20 and 21, those panels can be urged into the above noted desired contacting relationship with the element E by evacuating the atmosphere or air from between the panels 20 and 21 during assembly of the construction and at that time when the space between the edge portions of the panels are welded together.

While it is necessary and/or desirable that the above noted contacting relationship between the panels 20 and 21 and the element E be established for the purpose of effectively conducting heat throughout the heater structure, it is also necessary and desirable that the element E be free to move and shift longitudinally and laterally between the panels 20 and 21 and that the panels be such that they will readily part and permit such shifting of the element. Accordingly, if the structure is hermetically sealed, as noted above, sufficient air s extracted from between the panels 20 and 21 to effect the desired contacting relationship with and between the panels and the element E but not so much air is extracted to urge and hold the panels and element so tight as would prevent relative shifting and moving of the panels and element.

In accordance with our invention, the element E is engaged with and between the panels 20 and 21 of the sheath S so that upon the application of the forces in and through the element and/or through the sheath S which tend to cause the element E to move longitudinally and/or laterally between the panels, the element E will move substantially freely between the panels, as illustrated in FIG. 8 of the drawings. The force required to effect relative movement of the element between the panels 20 and 21 is materially less than the force required to effect drawing and/or stretching of the sheath S and/or the element E.

With the structure thus far described, it will be apparent that if and when forces are applied to and through the sheath S, which deform and cause parts or portions of the sheath to stretch, those forces are not imparted into and through the element E to cause stretching of that element. Instead, the element E is substantially free to move independent of and within the sheath, within safe, practical limits.

When the element E moves laterally, relative to its longitudinal axis and within the sheath, the top panel 20 of the sheath is displaced by the element and conforms with the element to maintain substantial uniform heat conducting contact with and about the upper half of the element at all times and the portion of the panel 20 from which the element has moved moves into substantial uniform heat conducting contact with related opposing portions of the panel 21.

With the heater construction thus far described, the only dead air spaces within the sheath which can interfere with the uniform conduction and distribution of heat occur between the panels 20 and 21 along opposite lower segments of the element E. These dead air spaces are of minimum volumetric extent and are substantially uniform and constant in nature as they extend longitudinally of the element E, whereby their heat insulating effect is minor and is so uniform and predictable that the establishment of any adverse effects thereby is unlikely to occur.

Further, with the structure thus far described, the convex radii of the portions of the panel 20 above and along the element E and their related concaved radii at the opposite lower sides of the element E present no undercuts or the like into which the liner L or lower panel 16 of the mattress M might not readily enter and conform with and are of sufficiently large radial extent that the liner L and/or panel 16 of the mattress can and does substantially conform therewith to establish uniform heat conducting contact, without the likelihood of folding, creasing or cracking the liner L or panel 16.

The base laminate 22 and heat reflecting stratum R are related to each other and with the bottom panel 21 in intimate uniform heat conducting contact with each other. In practice, when the stratum R consists of a sheet of aluminum foil or an equivalent heat reflecting and conducting medium, the foil can be bonded with and between the laminates by a suitable contact cement and the edge portions of the laminates 21 and 22 which extend outwardly from the edges of the stratum R can be cemented or welded together. When the stratum R is a vapor deposited coating or the like on the laminate 22 or on the panel 21, the surface of the laminate or panel which opposes the exposed surface of the deposited stratum can be cemented into uniform contacting engagement with the stratum and the edge portions of the panel 21 and laminate 22 can be cemented or welded together.

In practice, if desired, instead of cementing the laminate 22, panel 21 and stratum R together, the related edge portions of the panel 21 and laminate 22 can be welded together to hermetically seal the space therebetween and sufficient air between the laminate and panel can be evacuated so that the panel, laminate and stratum R are drawn by vacuum or urged by atmospheric pressure in substantial uniform heat conducting contact with each other.

In operation, the heat reflecting metallic stratum performs two distinct and important functions. First, it reflects and directs heat advancing downwardly in and through the heater structure (above the stratum R) upwardly and back into and through the heater structure above the stratum R, whereby the amount of heat that is likely to be directed downwardly and out of the heater, into the pad P of a related foam water bed, is materially reduced. Second, the stratum R serves as a heat conductor and conducts heat introduced into the bottom panel 21 below the element E, laterally outwardly relative to the element E and to those portions of the panel which are in heat conducting contact with the top panel 21 for conduction of heat into said top panel and subsequent conduction of said heat from said top panel into the mattress M, which is in heat conducting contact therewith.

In practice, it has been found that an aluminum foil stratum R, held in contact with the bottom panel is most desirable since the foil stratum is a better conductor of heat than is a vapor deposited heat reflecting stratum and because the foil is free to shift and move between and relative to the panel 21 and laminate 22 when the heater construction is deformed and stretched. Such free movement of the foil stratum R reduces the tendency and the likelihood that the foil will be torn and mutilated when and as the structure is worked.

In practice, it is preferred that the jacket 26 of the element E and that the panels 20 and 21 of the sheath above the stratum R be established of dark pigmented plastic resin so that their radiation heat absorbing characteristics are as great as is possible.

In practice, when the pad P is established of a non-compatible plastic, that is, a plastic that is such that it might draw or extract plasticizer from the base laminate 22 and cause embrittlement thereof, embrittlement of the base laminate and evantual cracking or crazing thereof will have little or no adverse effects since that laminate's only function is to hold or retain the stratum R in place. The stratum R establishes an effective barrier between the laminate 22 and the panel 21 through which plasticizer cannot migrate, whereby embrittlement of the panel 22, which might bring about adverse effects, cannot occur.

In practice, if the pad P of a related bed is established of a non-compatible plastic which will draw plasticizer from the heater structure and cause embrittlement thereof, a thin barrier film 30 of cast or thermo-set plastic such as Mylar can be loosely arranged beneath the laminate 22 and tack welded or cemented to the base laminate 22 of the heater about the perimeter thereof, as shown in dotted lines in FIGS. 7 and 8 of the drawings. Such a barrier film effectively prevents embrittlement of the heater.

Still further, should the mattress M of a related bed be established of or include a non-compatible such as synthetic rubber, a thin film of Mylar plastic or the like, similar to the film 30, noted above, can be related to the top surface of the heater H to establish a barrier between the heater and the mattress, through which the plasticizer in the heater cannot pass and cause embrittlement of the heater.

If desired, and in situations where the embrittlement of plastics as a result of the loss of plasticizers therefrom presents no problem, the portions of our heater construction which are made of plastic can be made of synthetic rubber or the like without departing from the broader aspects and spirit of our invention.

The heater structure H here provided is a soft, flexible, resilient and supple laminate structure in which the various components and/or parts can move substantially freely relative to each other whereby bending, folding, stretching and otherwise working the structure can be effected with no adverse effects within that range of working that is likely to be encountered when the heater is arranged between the pad and mattress of a foam water bed structure.

The heater structure H, when related to and used in combination with a foam water bed is an extremely efficient heat distributing and delivery means and is such that it can effectively and efficiently raise the temperature of the related water mattress to and maintain the temperature of that mattress at a set temperature which is less than or below 95° F., without requiring that the temperature of the heater ever exceed 115° F. or that temperature at which the plasticizer in the plastic parts of the heater is likely to be driven therefrom and result in embrittlement of the heater structure.

Having described only typical preferred forms and applications of our invention, we do not wish to be limited to the specific details herein set forth, but wish to reserve to ourselves any modifications and/or variations that may appear to those skilled in the art and which fall within the scope of the following claims:

Having described our invention, we claim:

1. A soft, resilient and flexible blanket-type electric resistance heater comprising a sheath including top and bottom panels of thin, supple, flexible, elastic and impervious plastic material; an elongate, flexible electric resistance element having greater tensile strength than the sheath is loosely arranged in a slack serpentine pattern between and throughout the plane of the panels with adjacent portions in variable spaced relationship from each other; the panels are sealed together about; the perimeter of the sheath; the panels are fixed together at locations between and spaced from adjacent related portions of the element to maintain adjacent portions of the element in spaced relationship from each other; the air in the space between the panels is exhausted therefrom to reduce the presence of heat insulating dead air spaces between the panels and to cause the panels to establish substantial uniform heat conducting contact with the element; an elongate power supply cord has one end portion within the sheath and has conductors connected with related ends of the heating element element and has another end portion outside the sheath extending to a power supply.

2. The heater structure set forth in claim 1 wherein said electric resistance element is cylindrical in cross-section and includes an elongate central flexible resistance wire and a jacket of supple, flexible, heat conducting dielectric plastic material about the wire, said element has greater tensile strength than the panels whereby the element will shift and move relative to and between the panels and will not stretch with the panels when the sheath is deformed and stretched by externally applied forces.

3. The heater structure set forth in claim 2 which further includes a base laminate of material similar to the material of which the panels are made and arranged beneath and adjacent to the bottom panel and a stratum of heat conducting and reflecting material between and retained by the bottom panel and the laminate to conduct and reflect heat advancing down through the bottom panel laterally and upwardly through said bottom panel and into said top panel for conduction into structure engaging said top panel.

4. The heater structure set forth in claim 1 which further includes a base laminate of material similar to the material of which the panels are made and arranged beneath and adjacent to the bottom panel and a stratum of heat conducting and reflecting material between and retained by the bottom panel and the laminate to reflect heat advancing down through the bottom panel laterally and upwardly through said bottom panel laterally and upwardly through said bottom panel and into said top panel for conduction into related structure engaging said top panel.

5. The heater structure set forth in claim 1 wherein said electric resistance element includes an elongate central flexible resistance wire and a jacket of flexible, heat conducting dielectric plastic material about the wire, the tensile strength of the element is at least equal to the tensile stress limits of the panels.

6. The heater structure set forth in claim 5 which further includes a base laminate of material similar to the material of which the panels are made and arranged beneath and adjacent to the bottom panel and a stratum of heat conducting and reflecting material between and retained by the bottom panel and the laminate to reflect heat advancing down through the bottom panel laterally and upwardly through said bottom panel laterally and upwardly through said bottom panel and into said top panel for conduction into structure engaging said top panel.

* * * * *